United States Patent [19]

Badesha et al.

[11] Patent Number: 4,772,525

[45] Date of Patent: Sep. 20, 1988

[54] PHOTORESPONSIVE IMAGING MEMBERS WITH HIGH MOLECULAR WEIGHT POLYSILYLENE HOLE TRANSPORTING COMPOSITIONS

[75] Inventors: Santokh S. Badesha, Pittsford; Milan Stolka, Fairport; Frederick J. Roberts, Jr., Webster; Ronald J. Weagley, Penfield, all of N.Y.

[73] Assignee: Xerox Corporation, Stamford, Conn.

[21] Appl. No.: 44,615

[22] Filed: May 1, 1987

[51] Int. Cl.[4] ..... G03G 5/14

[52] U.S. Cl. ..... 430/58; 252/518

[58] Field of Search ..... 430/58, 59

[56] References Cited

U.S. PATENT DOCUMENTS

| | | | |
|---|---|---|---|
| 4,464,460 | 8/1984 | Hiraoko et al. | 430/323 |
| 4,587,205 | 5/1986 | Harrah et al. | 430/326 |
| 4,588,801 | 5/1986 | Harrah et al. | 528/33 |
| 4,618,551 | 10/1986 | Stolka et al. | 430/58 |

*Primary Examiner*—J. David Welsh

*Attorney, Agent, or Firm*—E. O. Palazzo

[57] ABSTRACT

Photoresponsive imaging members comprised of hole transporting polysilylene compounds with a single peak molecular weight distribution, and wherein the polysilylenes selected have excluded therefrom molecular weight fractions of less than 50,000 thereby enabling, for example, the resulting imaging members to be substantially resistant to liquid ink developer compositions for an extended number of imaging cycles when these members are incorporated into electrostatographic imaging devices.

19 Claims, No Drawings

PHOTORESPONSIVE IMAGING MEMBERS WITH HIGH MOLECULAR WEIGHT POLYSILYLENE HOLE TRANSPORTING COMPOSITIONS

BACKGROUND OF THE INVENTION

This invention is generally directed to photoresponsive imaging members, and more specifically the present invention is directed to improved photoresponsive imaging members containing as hole transporting substances high molecular weight polysilylene compositions. In one important embodiment of the present invention, there is provided a layered photoresponsive imaging member comprised of a polysilylene hole transporting compound wherein the lower molecular weight fractions thereof are removed, and a photogenerating layer, which members are particularly useful in liquid development imaging processes. Further, there is provided in one particular aspect of the present invention an improved layered photoresponsive imaging member comprised of a supporting substrate, a photogenerating layer, and in contact therewith a hole transport layer comprised of a polysilylene compound, especially poly(methylphenyl silylene), poly(n-propylmethyl-co-cyclohexylmethyl silylene), and other similar polysilylenes with a weight average molecular weight of from about 400,000 to about 1,000,000; and wherein there are removed therefrom low molecular weight fractions such as those with a molecular weight of from about 4,000 to about 40,000. With further respect to the aforementioned imaging members, the polysilylene hole transporting compound layer can be located as the top layer of the imaging member, or alternatively may be situated between the supporting substrate and the photogenerating layer. Moreover, the present invention relates to the use of the improved imaging members of the present invention in electrophotographic, and especially xerographic, imaging processes including those wherein liquid and dry developer compositions are selected for rendering the images formulated visible.

The formation and development of electrostatic latent images on the imaging surfaces of photoconductive materials by electrostatic means is well known. The photoreceptor selected may comprise a conductive substrate containing on its surface a layer or layers of photoconductive insulating materials, and in many instances there can be used a thin barrier layer between the substrate and the photoconductive layer to prevent charge injection from the substrate into the photoconductive layer upon charging. Numerous different photoconductive members for use in xerography are known, including for example a homogenerous layer of a single material such as vitreous selenium, or composite layered imaging members with a photoconductive compound dispersed in other substances. An example of one type of composite photoconductive layer used in xerography is described, for example, in U.S. Pat. No. 3,121,006 wherein there is disclosed a number of layers comprising finely divided particles of photoconductive inorganic compounds dispersed in an electrically insulating organic resin binder.

There are also known photoreceptor materials comprised of other inorganic or organic materials wherein the charge carrier generation and charge carrier transport functions are accomplished by discrete contiguous layers. Additionally, photoreceptor materials are disclosed in the prior art which includes an overcoating layer of an electrically insulating polymeric material, and in conjunction with this overcoated type photoreceptor there have been proposed a number of imaging methods. However, the art of xerography continues to advance and more stringent demands need to be met by the copying apparatus to permit an increase in performance standards especially with liquid developer compositions, and to permit higher quality images. The photoconductive imaging member of the present invention represents such an improved member, and has other advantages as disclosed hereinafter.

Recently, there have been developed layered photoresponsive imaging members, including those comprised of generating layers and transport layers as disclosed in U.S. Pat. No. 4,265,990, and overcoated photoresponsive materials with a hole injecting layer overcoated with a transport layer, followed by an overcoating of a photogenerating layer and a top coating of an insulating organic resin, reference U.S. Pat. No. 4,251,612. Examples of photogenerating layers disclosed in these patents include trigonal selenium and metal, or metal free phthalocyanines. illustrative examples of the transport compounds that may be employed are comprised of certain aromatic amines as mentioned therein. The disclosures of each of these patents, namely U.S. Pat. Nos. 4,265,990 and 4,251,612, are totally incorporated herein by reference. The U.S. Pat. No. 4,265,990 patent is of particular interest in that it discloses layered photoresponsive imaging members similar to those illustrated in the present application with the exception that the hole transporting substances of this patent are comprised of aryl amine compositions, while in accordance with the present invention the hole transporting substance is a specific polysilylene.

Many other patents are in existence describing photoresponsive imaging members including layered imaging members with generating substances such as U.S. Pat. No. 3,041,167, which describes an electrophotographic imaging member with an overcoated imaging member containing a conductive substrate, a photoconductive insulating layer, and an overcoating layer of an electrically insulating polymeric material. This member is utilized in an electrophotographic copying method by, for example, initially charging the member with an electrostatic charge of a first polarity, and imagewise exposing to form an electrostatic latent image which can be subsequently developed to form a visible image.

In U.S. Pat. No. 3,041,116 there is disclosed a photoconductive material with a transparent plastic material overcoated on a layer of vitreous selenium, which is present on a recording substrate. Apparently, in operation the free surface of the transparent plastic is electrostatically charged to a desired polarity, followed by exposing the imaging member to activating radiation, which generates a hole electron pair in the photoconductive layer, and wherein the electrons move to the plastic layer and neutralize the positive charges contained on the free surface of the plastic layer, thus creating an electrostatic image. Also, there is disclosed in U.S. Pat. Nos. 4,232,102 and 4,233,383, the disclosures of which are totally incorporated herein by reference, the use of sodium carbonate doped and barium carbonate doped photoresponsive imaging members containing trigonal selenium. Other representative patents disclosing layered photoresponsive imaging members include 4,115,116; 4,047,949 and 4,081,274.

In addition, there are also known layered photoresponsive imaging members wherein there are selected various squaraine compounds, reference for example U.S. Pat. Nos. 4,552,822; 4,415,639; 4,471,041; and 4,486,520, the disclosures of each of these patents being totally incorporated herein by reference.

There is also illustrated in U.S. Pat. No. 4,618,551, the disclosure of which is totally incorporated herein by reference, photoresponsive imaging members similar to those described in the present application with the primary exception that the photoresponsive imaging members of the present invention contain therein specific polysilylenes of an average molecular weight of about 400,000 to about 1,000,000, and wherein the low molecular weight fractions thereof of, for example, from about 4,000 to about 50,000, are removed. More specifically, there is illustrated in the aforementioned patent a polysilylene hole transporting compound for use in imaging members, which compound is of the formula as illustrated in claim 1 with specific examples of polysilylenes being poly(methylphenyl silylene) of an average molecular weight of greater than 50,000. Additionally, there is disclosure presented in this patent wherein the molecular weight of the polysilylene is from about 300,000 to about 800,000. However, these polysilylenes also contain therein lower molecular weight fractions, that is from about 4,000 to about 50,000, which low molecular weight fractions are believed to cause the resulting imaging members to be less resistant to liquid developers.

Moreover, the imaging members with the polysilylenes of the '551 patent are susceptible to cracking with usage which adversely effects image quality, and depending on the extent of cracking no images whatsoever may be generated. In addition, the polysilylenes of the '551 patent when exposed to liquid ink vehicles, for example subsequent to immersing the layered imaging member with the aforementioned polysilylene in Isopar L, the imaging member is susceptible to some cracking. In contrast, the imaging members of the present invention with the low molecular weight fractions removed, and particularly polysilylenes with a weight average molecular weight of from about 400,000 to about 1,000,000 with substantially no molecular weight fractions present with a weight average molecular weight of from about 4,000 to about 40,000, will not crack when immersed in Isopar L; and these imaging members possess the other advantages indicated herein.

Illustrated in U.S. Pat. No. 4,588,801 are polysilylene positive photoresist materials and processes for the preparation thereof. More specifically, it is indicated in column 11, beginning at line 23, of this patent that the polysilylenes are prepared by polymerizing halosilylenes, preferably dichloro silylenes, in the presence of an alkali metal catalyst, preferably sodium, and an inert solvent such as toluene at elevated temperatures of, for example, from 90° to 100° C. and under reflux; also note the disclosure in column 12, Example 1, lines 21, through column 13, line 15. A similar teaching is presented in U.S. Pat. Nos. 4,587,205 and 4,464,460.

Although imaging members with various hole transporting substances are suitable for intended purposes, there continues to be a need for improved members, particularly layered members which are comprised of specific polysilylenes; and which members are substantially completely resistant to liquid developer compositions. Moreover, there continues to be a need for specific layered imaging members which not only generate acceptable images, but which can be repeatedly used in a number of imaging cycles without deterioration thereof from the machine environment or surrounding conditions. Additionally, there continues to be a need for improved layered imaging members wherein the materials employed for the respective layers, particularly the hole transporting layer, are substantially inert to the users of these members. Further, there continues to a need for improved photoresponsive imaging members which can be prepared with a minimum number of processing steps, and wherein the layers are sufficiently adhered to one another to allow the continuous use of these imaging members in repetitive imaging processes. Also, there continues to be a need for new hole transporting compounds that are also useful as protective overcoating layers, and as interface materials for various imaging members. Furthermore, there is a need for hole transporting polysilylene compositions that may be useful as binder polymers for photogenerating substances comprised of organic materials. There also is a need for new hole transporting substances which enable increased mobility of holes in layered imaging members. Likewise, there is a need for hole transporting compounds with increased stability, for example, wherein there is no extraction of these compounds from the layered imaging members in which they are incorporated when, for instance, liquid developers are selected for rendering the latent electrostatic latent image visible. Furthermore, there is a need for hole transporting compounds useful in layered imaging members, which compounds are superior insulators in the dark compared to may other known hole transporting compounds, thus enabling charging of the resulting imaging member to higher fields while maintaining cyclic stability, and allowing improved developability. Also, there is a need for imaging members with new hole transporting compounds which can function as resinous binders. Additionally, there is a need for enabling the preparation of imaging members with new hole transporting compounds, wherein the preparation allows for the selection of a variety of solvents, inclusive of toluene, benzene, tetrahydrofuran, cyclohexane, and halogenated solvents in addition to methylene chloride.

Moreover, there is a need for layered photoresponsive imaging members with polysilylenes wherein low molecular weight fractions of from about 4,000 to about 40,000 have been removed thereby enabling members that are resistant to cracking and can be selected for electrophotographic imaging processes, especially wherein liquid developer compositions are utilized. There is also a need for flexible layered imaging members with polysilylenes of a weight average molecular weight of from about 400,000 to 1,000,000, and wherein the ratio of the weight average molecular weight to the number average molecular weight is from about 1.3 to about 3.0.

SUMMARY OF THE INVENTION

It is therefore an object of the present invention to provide improved imaging members with polysilylenes of certain molecular weights.

In another object of the present invention there are provided layered photoresponsive imaging members containing therein polysilylene hole transporting substances wherein the low molecular weight portions thereof are removed.

In a further object of the present invention there is provided an improved photoresponsive imaging member with a photogenerating layer situated between a supporting substrate and a hole transporting layer comprised of the polysilylenes disclosed hereinafter.

In yet another object of the present invention is provided an improved photoresponsive imaging member comprised of polysilylenes hole transporting compound layer situated between a supporting substrate and a photogenerating layer or layers.

In still yet another object of the present invention there is provided an improved photoresponsive imaging member comprised of hole transporting compounds and photogenerating pigments, and as a protective overcoating the polysilylene compositions disclosed hereinafter.

In yet another object of the present invention there is provided an improved photoresponsive imaging member wherein the polysilylene compositions illustrated herein function as binder polymers for the photogenerating pigments.

In an additional object of the present invention there is provided an amorphous silicon photoresponsive imaging member with a protective overcoating thereover of the polysilylene compositions disclosed herein.

In yet another object of the present invention there are provided imaging methods with the improved imaging members illustrated.

Another object of the present invention resides in the provision of layered imaging members comprised of hole transporting polysilylene compounds enabling improved insulating characteristics in the dark for the resulting member thus allowing charging to higher fields while maintaining cyclic stability, and improving developability.

Another further object of the present invention resides in the provision of layered imaging members comprised of hole transporting polysilylene compounds of improved stability thus undesirably avoiding extraction of the hole transport compound with, for example, liquid developer compositions.

In yet an additional object of the present invention there are provided layered imaging members which can be prepared with a variety of solvents, including toluene, benzene, tetrahydrofuran, and halogenated hydrocarbons in addition to methylene chloride.

Further, in another object of the present invention there are provided processes for accomplishing the preparation of polysilylenes useful as hole transporting components wherein the lower molecular weight fractions thereof, that is from about 4,000 to about 50,000, are removed; and there are obtained polysilylenes with a weight average molecular weight of from about 400,000 to about 1,000,000.

These and other objects of the present invention are accomplished by the provision of imaging members comprised of a certain polysilylene. More specifically, the present invention is directed to an improved photoresponsive imaging member comprised of a photogenerating layer, and in contact therewith a hole transport layer comprised of polysilylenes of a weight average molecular weight of from about 400,000 to about 1,000,000, and a ratio of weight average to number average molecular weight of from 1.3 to about 3.0.

In one specific embodiment, the present invention is directed to an improved photoresponsive imaging member comprised of a supporting substrate, a photogenerating layer comprised of inorganic or organic photoconductive pigments optionally dispersed in an inactive resinous binder, and a layer comprised of a polysilylene hole transporting compound illustrated herein; and wherein molecular weight fractions of from about 4,000 to about 50,000 are excluded therefrom. Another specific photoresponsive imaging member of the present invention is comprised of the polysilylene hole transporting compounds illustrated herein situated between a supporting substrate and the photogenerating layer.

The polysilylene hole transporting compounds of the present invention include generally polymers of a weight average molecular weight of from about 400,000 to about 1,000,000, and a ratio of weight average to number average molecular weight of from about 1.3 to about 3.0, especially homopolymers, copolymers, or terpolymers of the following formula:

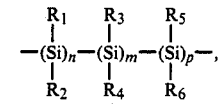

wherein $R_1$, $R_2$, $R_3$, $R_4$, $R_5$, and $R_6$ are independently selected from the group consisting of alkyl, aryl, substituted alkyl, substituted aryl, and alkoxy; and m, n, and p are numbers that reflect the percentage of the particular monomer unit in the total polymer composition with the sum of n plus m plus p being equal to 100 percent; and wherein there are excluded polysilylenes with weight average molecular weight fractions of below 50,000 and specifically of from about 4,000 to about 50,000. Specifically thus, for example, zero percent is less than, or equal to n, and n is less than or equal to 100 percent; and zero percent is less than, or equal to p, and p is less than, or equal to 100 percent.

Examples of alkyl groups include those that are linear, or branched of from one carbon atom to about 24 carbon atoms, and preferably from 1 carbon atom to about 8 carbon atoms, inclusive of methyl, ethyl, propyl, butyl, amyl, hexyl, octyl, nonyl, decyl, pentadecyl, stearyl; and unsaturated alkyls inclusive of allyls, and other similar substitutents. Specific preferred alkyl groups are methyl, ethyl, propyl and cyclohexyl butyl. Aryl substituents are those of from 6 carbon atoms to about 24 carbon atoms, inclusive of phenyl, naphthyl, anthryl, and the like. These alkyl and aryl groups may be substituted with alkyl, aryl, halogen, nitro, amino, alkoxy, cyano, and other related substituents. Examples of alkoxy groups include those with from 1 carbon atom to about 10 carbon atoms, such as methoxy, ethoxy, propoxy, butoxy, and other similar substitutents.

Illustrative specific examples of polysilylene hole transporting compounds included within the scope of the present invention, and encompassed within the formulas illustrated hereinbefore with the molecular weights indicated are poly(methylphenyl silylene), poly(methylphenyl silylene-co-dimethyl silylene), poly(cyclohexylmethyl silylene), poly(tertiary-butylmethyl silylene), poly(phenylethyl silylene), poly(n-propylmethyl silylene), poly(p-tolymethyl silylene), poly(cyclotrimethylene silylene), poly(cyclotetramethylene silylene), poly(cyclopentamethylene silylene), poly(di-t-butyl silylene-co-di-methyl silylene), poly(diphenyl silylene-co-phenylmethyl silylene), poly(cyanoethylmethyl silylene), poly(2-acetoxyethylmethyl silylene), poly(2-carbomethoxyethylmethyl silylene), poly(phenylmethyl silylene), about 90 percent with about 10 percent by weight of a dispersed aryl amine, especially N,N'-bis(3-methyl phenyl) 1, 1'-biphenyl-4, 4'-diamine, and the like.

The improved photoresponsive imaging members of the present invention can be prepared by a number of known methods, the process parameters, and the order of the coating of the layers being dependent on the member desired. Thus, for example, the improved photoresponsive members of the present invention can be prepared by providing a conductive substrate with an optional hole blocking layer, and optional adhesive layer; and applying thereto by solvent coating processes, laminating processes, or other methods a photogenerating layer and the polysilylene hole transport layer. Other methods include melt extrusion, dip coating, and spraying.

With further respect to the present invention, there can be prepared a negatively charged photoresponsive imaging member comprising a supporting substrate, an optional adhesive blocking layer thereover, a charge carrier photogenerating layer in contact therewith comprised of a photogenerating pigment optionally dispersed in inactive resinous binder composition, and thereover a hole transport layer comprised of the polysilylene hole transporting substance illustrated herein. In an alternative embodiment of the present invention, the hole transporting layer can be situated between the supporting substrate and the photogenerating layer resulting in a positively charged imaging member. More specifically, a negatively charged photoresponsive imaging member of the present invention can be comprised in the order indicated of a conductive supporting substrate of aluminized Mylar, an optional adhesive blocking layer, a photogenerating layer comprised of a trigonal selenium photogenerating pigment or other similar inorganic pigments, as well as organic pigments, dispersed in a resinous binder, and a hole transport layer comprised of a poly(methylphenyl silylene) of a weight average molecular weight of from about 500,000 to about 700,000, and a weight average number average ratio of 1.6 to 1.8.

Furthermore, a negatively charged photoresponsive imaging member of the present invention can be comprised of a conductive supporting substrate of aluminized Mylar; an optional adhesive blocking layer; a photogenerating layer comprised of an. inorganic or organic photogenerating pigment 36, inclusive of trigonal selenium; vanadyl phthalocyanine; cadmium-sulfur-selenide dispersed in a polysilylene resinous binder; and a hole transport layer comprised of a poly(methylphenyl silylene) of a weight average molecular weight of from about 500,000 to about 700,000, and a weight average number average ratio of 1.6 to 1.8.

In addition, a positively charged photoresponsive imaging member of the present invention can be comprised of a conductive supporting substrate of aluminized Mylar, in contact therewith a hole transporting layer comprised of the polysilylenes illustrated herein, a photogenerating layer containing photogenerating pigments inclusive of amorphous selenium, trigonal selenium, vanadyl phthalocyanine, cadmium-sulfur-selenide optionally dispersed in a resinous binder, and a protective overcoating layer.

Another positively charged imaging member of the present invention is comprised of a conductive supporting substrate, a hole transport layer comprised of the poly(methylphenyl silylene) illustrated hereinbefore, a photogenerating layer comprised of an evaporated photogenerating pigment dispersed in a resinous binder, and an overcoating layer such as the silanes of U.S. Ser. No. 346,423, now abandoned, the disclosure of which is totally incorporated herein by reference, comprised of aryl amines dispersed in a resinous binder, such as polycarbonates, which overcoating also contains therein carbon black particles. These overcoatings do not retain charge, reference U.S. Pat. No. 4,515,882, the disclosure of which is totally incorporated herein by reference.

The supporting substrate layers may be opaque or substantially transparent, and may comprised any suitable material having the requisite mechanical properties. Thus, the substrate may comprise a layer of nonconducting material such as an inorganic or organic polymeric material, a layer of an organic or inorganic material having a conductive surface layer arranged thereon or a conductive material such as, for example, aluminum, chromium, nickel, indium, tin oxide, brass or the like. The substrate may be flexible or rigid and may have any of many different configurations such as, for example, a plate, a cylindrical drum, a scroll, an endless flexible belt and the like. Preferably, the substrate is in the form of an endless flexible belt. The thickness of the substrate layer depends on many factors including economical considerations. Thus, this layer may be of substantial thickness, for example, over 100 mils or minimum thickness providing there are no adverse effects on the system. In one preferred embodiment, the thickness of this layer ranges from about 3 mils to about 10 mils.

Examples of the photogenerating pigments are as illustrated herein, inclusive of amorphous selenium, selenium alloys, such as $As_2Se_3$, trigonal selenium metal free phthalocyanines, metal phthalocyanines, vanadyl phthalocyanines, squaraines, and the like, with $As_2Se_3$ being preferred. Typically, this layer is of a thickness of from about 0.3 microns to about 10 microns or more in thickness, however, dependent on the photoconductive volume loading which may vary from 5 to 100 volume percent, this layer can be of other thicknesses. Generally, it is desirable to provide this layer in a thickness which is sufficient to absorb about 90 percent or more of the incident radiation which is directed upon it in the imagewise exposure step. The maximum thickness of this layer is dependent primarily upon facts such as mechanical considerations, for example whether a flexible photoresponsive imaging member is desired.

Optional resin binders for the photogenerating pigments are, for example, the polymers as illustrated in U.S. Pat. No. 3,121,006, the disclosure of which is totally incorporated herein by reference, polyesters, polyvinyl butyrals, polyvinyl carbazoles, polycarbonate resins, epoxy resins, polyhydroxyether resins, and the like. This layer can be of other thicknesses providing the objectives of the present invention are achieved; thus, for example, when evaporated photogenerating pigments are selected the thickness of this layer is from about 0.5 microns to about 3 microns.

Also, with respect to the imaging members of the present invention of importance is the selection as a hole transporting layer of the specific polysilylenes illustrated herein, which polysilylenes can be optionally dispersed in inactive resinous binders. Generally, polysilylenes can be prepared by a number of methods, reference for example the aforementioned '551 patent, which methods are illustrated, for example, in the Journal of Organometallic Chemistry, page 198, C27, (1980), R. E. Trujillo; and the Journal of Polymer Science, Polymer Chemistry Edition, Vol. 22, pages 225 to 228, (1984). These polysilylenes, however, have a bimolar distribution of molecular weights wherein there is a high molecular weight fraction with a weight average molecular weight usually greater than 200,000 with molecular weights up to or exceeding 1,000,000; and wherein there is also present low molecular weight fractions with a weight average molecular weight of from typically between about 4,000 to about 50,000, and preferably from between about 4,000 and about 25,000. When the polysilylene contains the aforementioned low molecular weight fraction, that is less than 50,000 and from about 4,000 to about 25,000, substantial amounts of the transport layers undergo stress cracking as readily observed from a visual appearance thereof when this material is exposed, for example, to liquid ink compositions containing aliphatic ink vehicles such as isopar or other petroleum solvents. In accordance with the present invention, polysilylenes, and particularly poly(methylphenylsilylene), can be obtained which are resistant to aliphatic inks and possess the other advantages indicated herein by the condensation of dihalomethylphenyl silylenes with alkali metals wherein a sodium dispersion in mineral oil or other suitably aliphatic vehicles such as a light paraffin oil, a high volume alkane, and the like is added continuously at a controlled rate with vigorous stirring to a solution of the dihalo silylene in a suitable solvent such as toluene, xylene, or a mixture of these solvents with alkanes. More specifically, this process of the present invention enables polysilylenes with the molecular weights indicated herein, and which polysilylenes are substantially free of low molecular weight fractions of less than about 50,000.

More specifically, polysilylenes of a weight average molecular weight of from about 400,000 to about 2,000,000 with a weight average to number average ratio of 1.3 to about 3, and which polysilylenes contain substantially no low molecular weight fractions of, for example, those with a weight average molecular weight of 4,000 to 40,000, are obtained by reacting in an inert gas atmosphere from about 0.5 mole to about 10 moles of a dihalo disubstituted silylene monomer such as dichloro dialkyl silylene, dichloro diaryl silylene, dichloro alkyl aryl silylenes, and the like; wherein alkyl contains from about 1 to about 10 carbon atoms such as methyl, ethyl, propyl, butyl and hexyl; aryl contains from about 6 to about 24 carbon atoms such as phenyl, tolyl, xylol, and naphthyl, and halo includes chloro, fluoro, iodo, and bromo, which silylene is dissolved in an organic solvent such as toluenes, benzenes, xylenes, or mixtures thereof in an amount to permit a solution of from about 1 percent to about 50 percent of the monomer therein, with from about 1 mole to about 20 moles of an alkali metal, inclusive of sodium, potassium, or mixtures thereof, Thereafter, the aforementioned mixture is heated from about 70° to about 180° C., or other suitable effective temperatures depending on the boiling point of the solvent selected, while the mixture is continuously stirred. Subsequently, there is prepared an alkali metal dispersion believed to be comprised of an alkali metal dispersed in an oil such as mineral oil wherein the alkali metal content is from about 10 to about 80 percent, which dispersions are commercially available from Aldrich Chemical Company. The aforementioned commercially available alkali dispersion is then added to the reaction mixture in a continuous dropwise manner over a period of from about 5 minutes to about 1 hour with stirring and at reflux, or at a temperature of from about 70° to about 150° C., which heating and stirring is continued for a period of from about 30 minutes to about 10 hours to complete polymerization. After cooling, the reaction mixture obtained is filtered, the precipitate is discarded, and the liquid filtrate is poured onto a suitable nonsolvent material such as methanol, ethanol, decone, and hexane in a ratio of, for example, 1 to 10 by slowly adding liquid filtrate (which is a solution of the desired polymer) in a dropwise manner to the nonsolvent. There results as determined by gel permeation chromotography (GPC) polysilylenes with a weight average molecular weight of from 400,000 to about 1,000,000, which polysilylenes contain substantially or no considerable amount of low molecular weight components or fractions with weight average molecular weights of from about 4,000 to about 40,000.

The aforementioned polysilylenes of the present invention are also useful as protective overcoating materials for various photoreceptor members including amorphous selenium, selenium alloys, layered members containing selenium arsenic alloys as the top layer, reference U.S. Ser. No. 487,935 entitled Overcoated Photoresponsive Devices, the disclosure of which is totally incorporated herein by reference, and layered imaging members comprised of a photogenerating layer, and a diamine hole transport layer, reference U.S. Pat. No. 4,265,990 referred to hereinbefore. In this embodiment, the polysilylenes are applied as an overcoating to the imaging member in a thickness of from about 0.5 micron to about 7.0 microns, and preferably from about 1.0 micron to about 4.0 microns. Moreover, as indicated herein the polysilylene compositions of the present invention can be selected as resinous binders for the imaging members described herein, including inorganic and organic photogenerators such as trigonal selenium, selenium alloys, hydrogenated amorphous silicon, silicon-germanium alloys, and vanadyl phthalocyanine. In this embodiment, for example, the imaging member is comprised of a supporting substrate, a photogenerating layer comprised of a photogenerating pigment of trigonal selenium, or vanadyl phthalocyanine dispersed in the polysilylenes composition, which are now functioning as a resin binder, and as a top layer an aryl amine hole transport composition, reference the '990 patent mentioned herein, or polysilylenes.

Further, the polysilylene compositions of the present invention may also function as interface layers. As interface layers the polysilylenes are applied between, for example, a supporting substrate and the photogenerating layer, or the photogenerating layer and the hole transport layer, wherein there is provided improved adhesion of the respective layers. Other interface layers useful for the imaging members of the present invention include, for example, polyesters and similar equivalent materials. These adhesive layers are of a thickness of from about 0.05 micron to about 2 microns.

The imaging members of the present invention are useful in various electrophotographic imaging systems, especially xerographic systems, wherein an electrostatic image is formed on the photoresponsive imaging member, followed by the development thereof, transfer to a suitable substrate, and fixing of the resultant image. More specifically, the imaging members of the present invention with the polysilylenes indicated are particularly useful in imaging systems wherein there are selected known liquid developer compositions. Liquid developers usually are comprised of an oil base with pigment particles dispersed therein and other additives such as stabilizers.

Examples of adhesive blocking layers present in a thickness of from about 0.002 to 0.5 micron include various known materials such as aminopropyl triethoxy silanes and the like.

The invention will now be described in detail with respect to specific preferred embodiments thereof, it being understood that these examples are intended to be illustrative only. The invention is not intended to be limited to the materials, conditions, process parameters, etc. recited herein. All parts and percentages are by weight unless otherwise indicated.

EXAMPLE I

There was prepared a polysilylene by initially adding to a reaction flask 15 milliliters of dichlorophenyl methyl silane in 100 milliliters of dry toluene. Thereafter, there was added in a dropwise continuous manner 12 milliliters of a sodium dispersion over a period of 25 minutes, 40 percent by weight of sodium in a light oil, which dispersion is commercially available from Aldrich Chemical, which additive is accomplished under an inert dry gas argon atmosphere. Thereafter, and under an argon gas atmosphere, the contents of the reaction flask were heated and stirred at 110° C. for 3 hours, and subsequently there was added thereto 50 milliliters of toluene. There resulted a dark slurry which was filtered subsequent to cooling, and the filtrate, 70 milliliters, was slowly added to 700 milliliters of hexane resulting in a white precipitate which was then collected by filtration and dried. The aforementioned polysilylene precipitate, 1.35 grams, had a weight average molecular weight of 519,000, a weight average number average molecular weight ratio of 1.6, and substantially no molecular weight fractions of 4,000 to 20,000 as determined by GPC.

EXAMPLE II

A polysilylene was prepared by repeating the procedure of Example I with the exception that the sodium dispersion was added over a period of 15 minutes, and there resulted a polysilylene with a weight average molecular weight of 717,000, a weight average number average molecular weight ratio of 1.7, and substantially no molecular weight fractions of 4,000 to 20,000 as determined by GPC.

EXAMPLE III

There was prepared a photoresponsive imaging member by providing an aluminized Mylar substrate in a thickness of three mils, followed by applying thereto, with a multiple clearance film applicator in a wet thickness of 0.5 micron, an adhesive blocking layer of 3-aminopropyl triethoxy silane, available from PCR Research Chemicals of Florida, and ethanol in a 1:50 volume ratio. This layer was then allowed to dry for 5 minutes at room temperature, followed by curing for 10 minutes at 100° C. in a forced air oven. A photogenerating layer of amorphous selenium in a thickness of 0.4 micron was then applied to the silane layer. Thereafter, the amorphous selenium photogenerating layer was overcoated with a transport layer of a poly(methylphenylsilylene) obtained by the process of Example I from a solution of toluene and tetrahydrafuran, volume ratio of 2:1, this deposition being affected by spraying. There resulted after drying a charge transport layer of 10 microns in thickness.

This member was then inserted in a 500 milliliter beaker containing about 400 milliliters of isopar G, and remained in the beaker for one day. An examination of the imaging member subsequent to removal from the beaker indicated that no cracks appeared thereon. In contrast, when the aforementioned test was repeated with an imaging member with a poly(methylphenyl silylene) that contained therein low molecular weight fractions of 20,000, which polysilylene also contained high molecular weight fractions of from 400,000 to 1,000,000, there resulted after one day substantial cracks on the imaging member indicating that it would be unusuable in xerographic imaging processes with liquid developers. More specifically, there were observed on the aforementioned member 50 or more cracks.

Electrostatic latent images can then be generated on the above-prepared imaging member with the poly(methylphenyl silylene) of Example I by incorporating this member into a xerographic imaging test fixture, and after charging the member to a negative voltage of 1,000 volts, the resulting images can be developed with a toner composition comprised of 92 percent by weight of a styrene n-butylmethacrylate copolymer (58/42), 8 percent by weight of carbon black particles, and 2 percent by weight of the charge enhancing additive cetyl pyridinium chloride. There can be obtained, as determined by visual observation, developed images of excellent resolution and superior quality for 25,000 imaging cycles. Similar results can be obtained with liquid developer compositions containing about 92 percent of water, 7 percent by weight of a dye such as carbon black, and 1 percent of polyvinyl alcohol.

EXAMPLE IV

A photoresponsive imaging member was prepared by repeating the procedure of Example III with the exception that there was selected as the photogenerating pigment in place of the amorphous selenium an arsenic selenium alloy, 99.9 percent by weight of selenium, and 0.5 percent by weight of arsenic. Substantially similar results can be generated when this imaging member is used to obtain images for 25,000 cycles in accordance with the procedure of Example I.

Although the invention has been described with reference to specific preferred embodiments, it is not intended to be limited thereto; rather, those skilled in the art will recognize variations and modifications may be made therein which are within the spirit of the invention and within the scope of the following claims.

What is claimed is:

1. An improved layered photoresponsive imaging member comprised of a supporting substrate, a photogenerating layer, and a polysilylene hole transporting compound of the following formula with a weight average molecular weight of from about 400,000 to about 1,000,000, and a weight average molecular weight to a number average molecular weight ratio of from about 1.3 to about 3

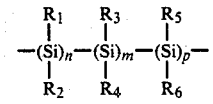

wherein $R_1$, $R_2$, $R_3$, $R_4$, $R_5$ and $R_6$ are independently selected from the group consisting of alkyl, aryl, substituted alkyl, substituted aryl, and alkoxy; and n, m, and p are numbers that represent the percentage of the monomer unit in the polysilylene compound.

2. An improved layered photoresponsive imaging member comprised of a supporting substrate, a photogenerating layer, and situated therebetween a polysilylene hole transporting compound of the following formula with a weight average molecular weight of from about 400,000 to about 1,000,000, and a weight average molecular weight to a number average molecular weight ratio of from about 1.3 to about 3

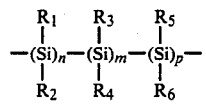

wherein $R_1$, $R_2$, $R_3$, $R_4$, $R_5$ and $R_6$ are independently selected from the group consisting of alkyl, aryl, substituted alkyl, substituted aryl, and alkoxy; and n, m, and p are numbers that represent the percentage of the monomer unit in the polysilylene compound.

3. An improved layered photoresponsive imaging member in accordance with claim 1 wherein the supporting substrate is conductive.

4. An improved layered photoresponsive imaging member in accordance with claim 1 wherein the photogenerating layer is comprised of photogenerating pigments selected from inorganic photoconductive pigments, and organic photoconductive pigments.

5. An improved layered photoresponsive imaging member in accordance with claim 4 wherein the inorganic pigments are amorphous selenium, selenium alloys, or trigonal selenium.

6. An improved layered photoresponsive imaging member in accordance with claim 4 wherein the organic pigments are metal phthalocyanines, metal free phthalocyanines, or vanadyl phthalocyanines.

7. An improved layered photoresponsive imaging member in accordance with claim 1 wherein the polysilylene is poly(methylphenyl silylene).

8. An improved layered photoresponsive imaging member in accordance with claim 1 wherein the polysilylene is poly(n-propylmethyl silylene)-co-methylphenylsilylene.

9. An improved layered photoresponsive imaging member in accordance with claim 2 wherein the polysilylene is poly(methylphenyl silylene).

10. An improved layered photoresponsive imaging member in accordance with claim 1 wherein there is further included thereover a protective overcoating.

11. An improved layered photoresponsive imaging member in accordance with claim 2 wherein there is further included thereover a protective overcoating.

12. A process of imaging which comprises providing the imaging member of claim 1, forming thereon an electrostatic latent image, thereafter accomplishing the development of this image, subsequently transferring the developed image to a suitable substrate, and optionally affixing the image thereto.

13. A process of imaging which comprises providing the imaging member of claim 2, forming thereon an electrostatic latent image, thereafter accomplishing the development of this image, subsequently transferring the developed image to a suitable substrate, and optionally affixing the image thereto.

14. A process for generating developed electrostatic latent images in accordance with claim 12 wherein the polysilylene is poly(methylphenyl silylene), poly(n-propylmethyl silylene)-comethylphenyl silylene, or poly(n-propylmetyl silylene).

15. A process for generating developed electrostatic latent images in accordance with claim 13 wherein the polysilylene is poly(methylphenyl silylene), poly(n-propylmethyl silylene)-co-methylphenyl silyene, or poly(n-propylmethyl silylene).

16. A process in accordance with claim 12 wherein there is selected as the developer compositions a liquid ink.

17. A process in accordance with claim 16 wherein the imaging member retain its electrical characteristics for 100,000 imaging cycles.

18. An improved layered imaging member in accordance with claim 1 wherein the polysilylene possesses a weight average molecular weight of about 519,000, and a weight average number average molecular weight ratio of 1.6.

19. An improved layered imaging member in accordance with claim 1 wherein the polysilylene possesses a weight average molecular weight of about 717,000, and a weight average number average molecular weight ratio of 1.7.

* * * * *